United States Patent [19]

Cerny

[11] Patent Number: 4,526,290

[45] Date of Patent: Jul. 2, 1985

[54] FLANGED CONTAINER

[75] Inventor: Daryl D. Cerny, Greenville, Ohio

[73] Assignee: Ball Corporation, Muncie, Ind.

[21] Appl. No.: 543,668

[22] Filed: Oct. 19, 1983

[51] Int. Cl.[3] ..... B65D 8/08; B65D 25/14

[52] U.S. Cl. ..... 220/415; 215/1 C; 220/67; 220/73; 220/74; 220/453; 229/3.5 R

[58] Field of Search ..... 220/67, 74, 77, 306, 220/73, 415, 453; 413/4, 5; 215/1 C; 229/3.5 R

[56] References Cited

U.S. PATENT DOCUMENTS

| | | | |
|---|---|---|---|
| 1,824,907 | 9/1931 | Lermer . | |
| 2,196,206 | 4/1940 | Foss | 220/67 |
| 2,277,066 | 3/1942 | Bogner . | |
| 2,321,408 | 6/1943 | Mills et al. | 220/67 |
| 2,363,352 | 11/1944 | O'Brien | 229/5.5 |
| 2,982,460 | 5/1961 | Hauptmann | 229/5.6 |
| 2,986,319 | 5/1962 | Bierman et al. | 229/5.6 |
| 2,988,258 | 6/1961 | Witzke | 220/74 X |
| 2,997,520 | 8/1961 | Kinsman | 220/306 X |
| 3,051,580 | 8/1962 | Brennan . | |
| 3,139,131 | 6/1964 | Hutchinson | 220/67 X |
| 3,230,093 | 1/1966 | Albertus . | |
| 3,405,439 | 10/1968 | Uemura . | |
| 3,410,939 | 11/1968 | Driza et al. . | |
| 3,452,897 | 7/1969 | Anthony | 220/67 |
| 3,685,685 | 8/1972 | Phillips | 220/67 |
| 3,923,190 | 12/1975 | Roth | 220/67 |
| 3,952,677 | 4/1976 | Hartman et al. . | |
| 4,030,850 | 6/1977 | Hyde | 220/306 |
| 4,270,475 | 6/1981 | Fletcher et al. . | |
| 4,398,648 | 8/1983 | Cerny et al. | 220/67 |

*Primary Examiner*—Allan N. Shoap

*Attorney, Agent, or Firm*—Gilbert E. Alberding

[57] ABSTRACT

A novel flange configuration for plastic containers that can be readily rolled or interfolded with a closure to form an interlocking double seam to provide a leak-proof container. A plastic container is described comprising a sidewall and bottom wall forming an open end with an outwardly extending flange surrounding the open end, said flange extending outwardly from a thin peripheral portion adjacent the open end to a thicker terminal portion, said peripheral portion being provided with a fold line of much thinner cross section.

6 Claims, 8 Drawing Figures

FLANGED CONTAINER

BACKGROUND OF THE INVENTION

This invention relates to a hermetically sealed container having a plastic container body and a metallic top and, more particularly, to a plastic container body having a peripheral flange at its open end adapted for closure and hermetic sealing by double-seaming.

Receptacles or can bodies are conventionally closed by metal top and seaming operations. Single seams may be used in conjunction with special chemical sealants to avoid leaks, but are not effective in the absence of the sealant to effectively render a container leak-proof. The application of such sealants requires clearance of the materials for toxicity and the like where the container is intended for edible substances. In double-seaming, a metal top is generally provided with a flange which is folded twice to provide two seams to capture a portion of the container thereby sealing the container.

More recently, plastic containers with reduced gas permeability are being developed for the storage of food and beverages. Such containers have a laminated or multilayered structure that is generally formed from one or more layers each of a thermoplastic material and a material having good gas-barrier properties. The thermoplastic materials are generally resilient, commonly used materials being, for example, polyethylene and polypropylene, which may be used to form both the inner and outer layers of the container. An interior gas-barrier layer is generally formed by a material such as polyamide, acrylonitrile, polyvinylidene chloride and ethylenevinyl alcohol copolymers.

When double seaming is used in an attempt to seal metal closures to such laminated multilayered thermoplastic container bodies, the containers frequently present leakage problems due to a number of reasons, but especially due to the tendency of the proximate plastic material to pull out of the metal closure. Moreover there is a marked tendency for the metal closure to simply cut into the plastic sidewall during the seaming operation. In addition, when such plastic containers are accidently dropped, they are frequently deformed to such an extent that their contents leak. In addition, the dimensions of plastic containers vary greatly from their standard shape because of their nature and the method by which they are manufactured. Attempts to close such containers by double-seaming metal ends frequently fail to achieve a reliable closure and seal because of the substantial variation in size of the flange formed in the plastic container. As a result, there is a substantial variation in the integrity and reliability of the seal obtained with plastic containers. In addition to these problems, efforts to double seam laminated container bodies have frequently resulted in fractures and cracks as well as delamination of the container body during the double-seaming operation because of the lack of flexibility and resiliency of the laminated container body to withstand the severe stresses encountered during double-seaming. U.S. Pat. No. 3,685,685 describes a plastic-metal container that is formed by double-seaming. In this double-seamed configuration, the plastic flange of the container is compressed at least to one-half the original thickness to form a seal. U.S. Pat. No. 3,923,190 shows one attempt to solve this problem in which a polymeric flange is double seamed to a metal closure. Moreover, U.S. Pat. No. 4,398,648 relates to a novel flange configuration that is useful in forming a good seam with metal closures, the configuration being effectively interfoldable with a standard metal closure to provide leak-proof containers.

A reliable seal is necessary for the container to be usable to store foods and beverages in a non-frozen or unrefrigerated state. The lack of seal integrity permits oxygen to enter the container and results in deterioration of any foodstuffs or beverages within the container which defeats the purpose of the included gas-barrier lamination.

SUMMARY OF THE INVENTION

This invention provides a plastic container with a reliable hermetically sealed, double-seamed, metal closure. The invention includes a plastic container body comprising an integral sidewall and bottom wall forming an open end with an integral flange surrounding the open end and extending outwardly from the thinner portion adjacent the open end to a thicker terminal portion.

In forming a closed container with the invention, a metal closure having an integral, outwardly extending metal flange with the re-entrant termination is placed within the open end of the plastic container concentric with the thicker termination of the container body flange. The outwardly extending flange of the metal closure is deformed by bending the re-entrant termination under and around the thicker terminal portion of the outwardly extending, plastic flange and further bending the metal flange and its re-entrant termination to form a double seam and to displace the thicker termination of the outwardly extending plastic flange within the double seal formed by the metal flange thereby closing and sealing the container.

The closed container thus formed comprises an integral plastic container portion forming a sidewall and a bottom wall and an open end closed and sealed by a metal closure. The plastic container body and metal closure each have outwardly extending flanges concentric with the container that had been deformed to provide a double-seam seal. The plastic container of the body has an originally thicker terminal flange portion that is enclosed within the terminal portion of the metal flange concentrically outside of the container and is displaced by the terminal portion of the metal flange by compression of the original thicker portion to effectively seal the container.

Other features and advantages of the invention will be apparent from the following drawings and detailed description of the preferred embodiment.

DETAILED DESCRIPTION OF THE PREFERRED EMBODIMENTS

Figure 1:
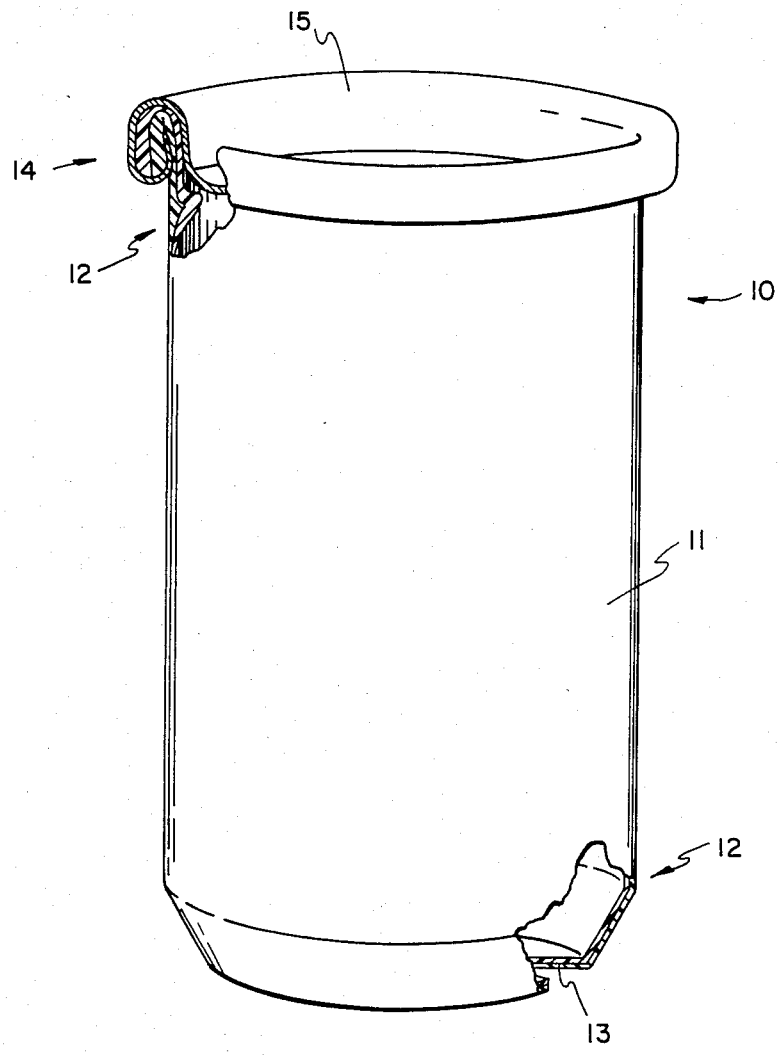
FIG. 1 is a drawing of a multilayered container of this invention partially broken away to show the double-seaming of its closure and its interior.

FIG. 1 shows a closed container 10 of this invention. The container includes, as its body, an integral plastic portion 11 forming a sidewall 12 and a bottom wall 13 and an end 14 adapted to be closed and sealed. The integral plastic body portion 11 is a laminated or multi-layered structure, including an interior laminate 11*b* of polyvinylidene chloride or saran, or the like, having a uniform thickness on the order of one to several thousands of an inch and outer laminates 11*a* and 11*c* of such thermoplastic materials as polyethylene or polypropylene. The container includes a metal closure 15, typically aluminum, for the plastic container body; and the container body 11 and metal closure 15 each have outwardly extending flanges concentric with the container that have been deformed to provide a double-seamed seal at the open end of the container body.

In accordance with the invention, the open end of the container body 11 has been provided with an outwardly extending flange having a thicker terminal portion (note FIGS. 2, 5, 6, and 7) which is displaced within the double seal by the terminal portion of the metal flange through compression in the double-seaming operation.

Figure 2:
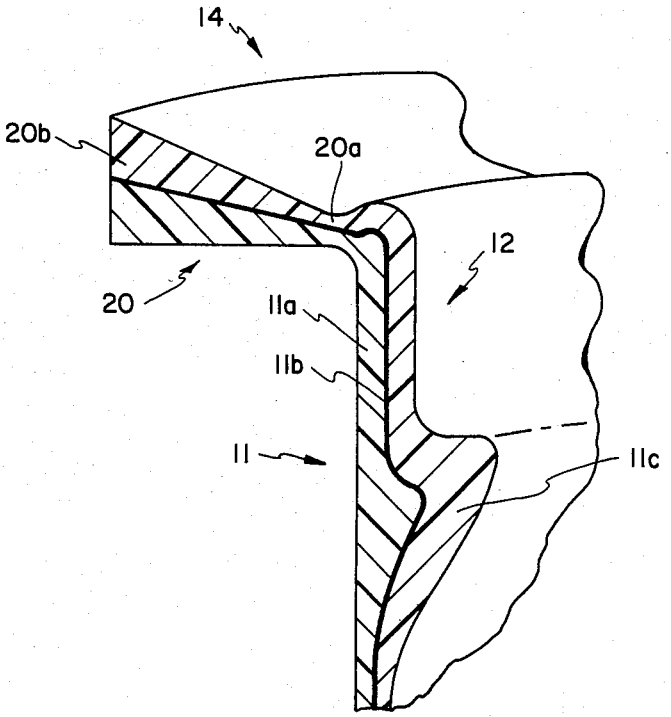
FIG. 2 is a partial cross-sectional view of the flange portion of the container body of FIG. 1.

Referring now specifically to FIG. 2, a cross section of the flange portion 20 of container body 11 is shown at a plane passing through the central axis of and bisecting the container body 11. As shown in FIG. 2, the sidewall 12 is adapted at its open end 14 to be closed and sealed. This adaption takes the form of a flange 20 extending outwardly from a thinner peripheral portion 20*a*, adjacent to and as thin as or thinner than the open end of the container body 11 to a thicker terminal portion 20*b*. In preferred embodiments of the flange, the thicker terminal portion 20*b* is about two to four times as thick as the thinner portion 20*a*. The thinner portion 20*a* may be thinner than the sidewall 12. The thinner portion permits a concentric area of preferential bending, and the thicker terminal portion is sufficiently thicker than the sidewall to provide a preferentially displaceable portion of the flange for the double-seaming operation.

The thinner portion 20*a* of the flange 20 has a thickness of about 0.005 to about 0.015 inch. The thicker termination of the flange 20*b* has a dimension of between about 0.030 and about 0.050 inch and preferably about 0.040 inch. Flanges with such dimensions are typically formed on a container body having sidewalls 12 with a thickness between about 0.015 and about 0.030 inch and preferably about 0.020 inch.

Figure 3:
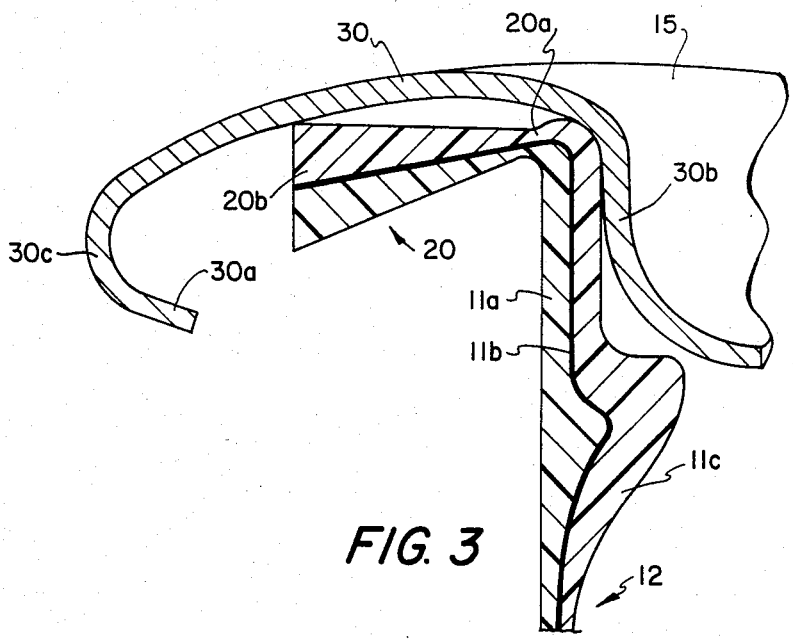
FIG. 3 is a partial cross-sectional view of the flange portion of the container body of FIG. 1 showing the metal closure in place in the open end of the container body before the double-seaming operation.
Figure 4:
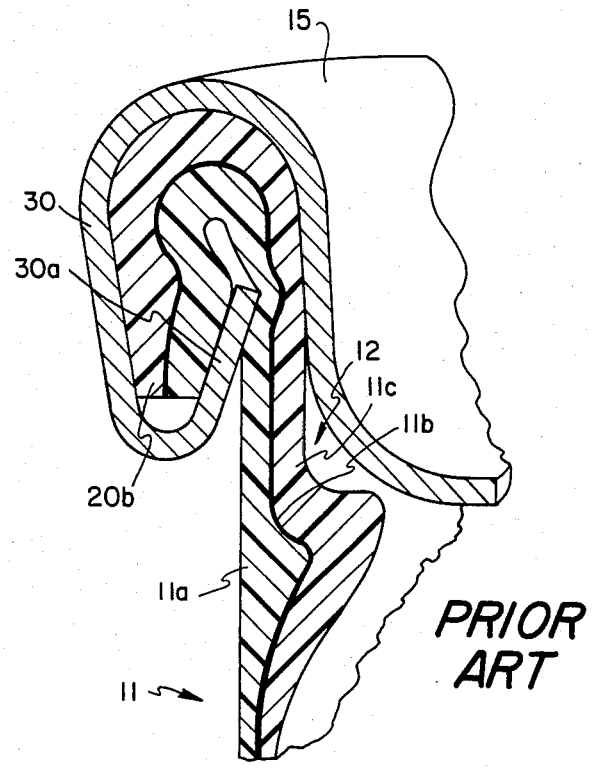
FIG. 4 is a partial cross-sectional view of a double-seamed flange of a container as formed by the prior art.
Figure 8:
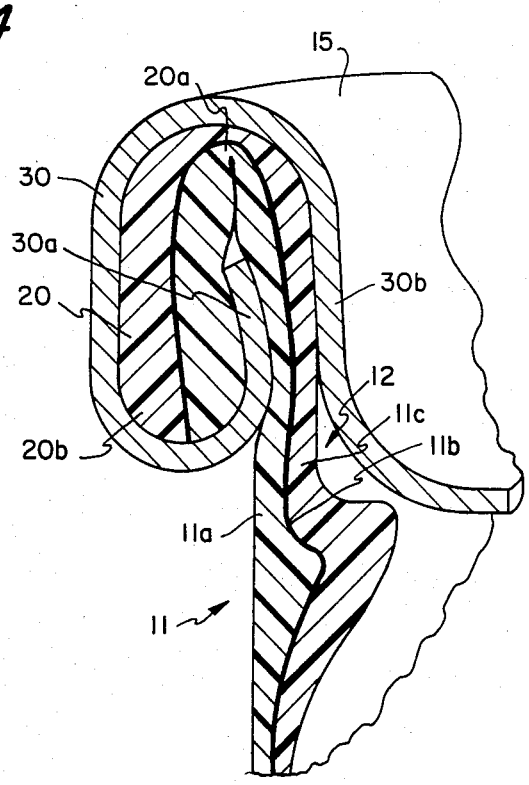
FIG. 8 is a partial cross-sectional view of a double-seamed flange of the container of FIG. 1.

FIGS. 3 and 8 illustrate the method of forming a closed container of FIG. 1 from plastic container bodies such as that shown in the partial view of FIG. 2 with this invention. FIG. 3 is a partial cross-sectional view of the flange portion of the container with the metal closure 15 placed in the open end 14 of the container body 11. The metal closure 15 has an outwardly extending metal flange 30 with a re-entrant termination portion 30*a*. Upon placing the metal closure 15 over the open end 14 of the container body 11, the re-entrant termination 30*a* is positioned concentrically with respect to flange 20 of the container body 11 and its thicker termination 20*b*.

The closed container of FIG. 1 is formed by double-seaming the metal closure 15 to the container body 11. In a double-seamed configuration of FIG. 8, the re-entrant termination 30*a* of the metal flange 30 is bent under the outwardly extending plastic flange 20 and the metal flange 30 is further bent to form a double seam. In the bending and forming of the double seam, the thicker termination 20*b* of flange 20 is displaced by compression and the resilience of the thermoplastic layers of the container body material forming the flange portion 20 maintains a hermetic seal of the closed container body. By such displacement of the thicker termination portion 20*b* that portion is forced into unfilled areas that would otherwise remain open, the displacement causing the formation of a continuous seal. It should be pointed out that during the initial seaming process the bulky group allows the metal of the closure to fold around the group and to thereby secure it into a deep pocket-like structure. If the plastic flange were of conventional configuration, that is of generally flat cross section, the metal closure would not properly fold or bend around the plastic flange and would instead be forced or evicted from the pocket during the seaming operation, especially under high compressive forces.

The cross section of the flange 20 may vary to some degree, the wedge-shaped structure in FIG. 2 being a preferred embodiment. In the embodiment of FIG. 2, the thinner portion 20*a* of flange 20 is thinner than the sidewall of the container body.

Figure 5:
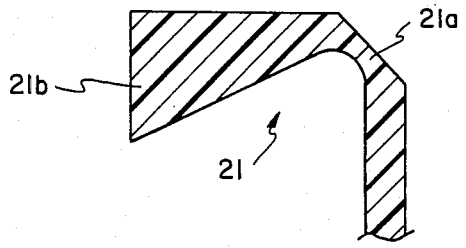
FIG. 5 is a partial cross-sectional view of a flange portion of another container body of this invention.
Figure 6:
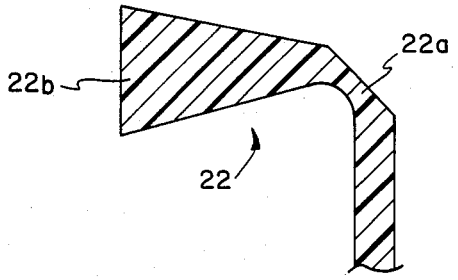
FIG. 6 is a partial cross-sectional view of the flange portion of another container body of this invention.
Figure 7:
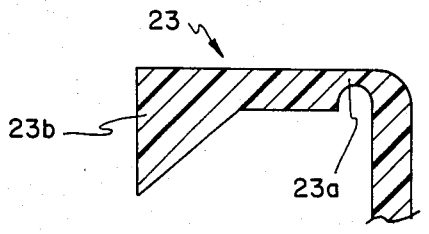
FIG. 7 is a partial cross-sectional view of the flange portion of another container body of this invention.

FIGS. 5, 6, and 7 show alternate embodiments although the embodiment of FIG. 2 is particularly preferred. In the embodiment of FIG. 5, the flange 21 terminates in a thicker portion 21*b* and forms a wedge-shaped cross section. The embodiment of FIG. 6 likewise includes a thicker termination 22*b* of flange 22. In the embodiments of FIGS. 5 and 6, the thinner portions 21*a* and 22*a* are thinner than the sidewalls of the container body.

In the embodiment of FIG. 7, the flange 23 terminates in a thicker portion 23*b* and forms a modified wedge (a wedge attached to a substantial rectangular portion) with a thinner peripheral portion 23*a*.

The included angle of the wedge-shaped cross section in each of the four embodiments may range from about 10° to about 45°, with about 15° being preferred; and in each of the four embodiments, the thicker portion of the flange may be from about 2 to about 4 times thicker than the thinner portion of the flange. In the embodiments of FIGS. 5, 6 and 7, the thinner portion of the flange can be typically 0.010 inch and thicker terminations 21*b*, 22*b*, and 23*b* about 0.040 inch. In each of the embodiments, FIGS. 2, 5, 6 and 7, the length of the flange from the thicker termination 20*b*, 21*b*, 22*b*, and 23*b*, respectively, to the inside surface of the container wall is about 0.100 inch. The corresponding, outwardly extending flange 30 of the metal enclosure 15 should have a radial extent from its inside surface 30*b* to its outermost extremity 30*c* of up to about 0.200 inch. The height of flange 30 from its re-entrant termination 30*a* to its uppermost surface may typically be about 0.080 to about 0.113 inch.

It will be generally appreciated that the configuration herein disclosed has numerous advantages over prior configurations. It is apparent from the subject invention that a reservoir of plastic material is provided at the most terminal portion of the flange wherefrom the plastic material, upon being deformed in a double-seaming operation, would be displaced inwardly toward the thinner portion. Although the reservoir of plastic material may taper inwardly to almost adjacent to the thin portion of the flange, it may also terminate as some intermediate position, that is between the terminal and the thin portion. Because of the shortness of the plastic flange structure it is essential to provide said structure with a fold line 20*a* of substantially reduced cross section to allow said flange to fold in a predictable manner.

The invention provides a structure that is easily folded into a double-seam configuration. When double-seamed, the container flange resists being pulled from the metal closure and provides a much improved seal. The invention permits the closure and sealing of containers reliably notwithstanding a wide variation in the dimensions of the plastic container flange as a result of its manufacture, thus compensating for manufacturing tolerances of such plastic containers.

It has been observed that leak-proof containers are formed in accordance with this invention when certain spacial or dimensional relationships are maintained. In particular, the thickness of the sidewall that is encapsulated or entrapped between the terminal end 30*a* and the inside section 30*b* of the closure should be equal to an amount between about 75% to about 90% of the original thickness of the wall of the container. As already disclosed hereinabove, the bulky group or termination 20*b* provides an effective mandrel-like appendage around which the free or terminal end 30*a* is formed, allowing a more gradual radius of curvature to be defined as opposed to a pinched-off configuration that is commonly found in the prior art configurations. It will be appreciated that this gradual or fuller radius provides an enclosure or nest for the bulky group that is firmly secured therein. Moreover, the terminal end 30*a* is properly spaced, said terminal end being positioned substantially parallel to the finished internal as well as external sidewall sections of the closure.

Although the invention has been shown in its preferred embodiments, other embodiments may be readily devised without departing from the spirit and scope of the following claims.

I claim:

1. A closed, double-seamed container, comprising an integral plastic portion forming a sidewall and a bottom wall and an end adapted to be closed and sealed, and a metal closure for the end of the plastic portion, said plastic portion and said metal closure each having outwardly extending flanges that have been formed to provide a double-seam seal, the outwardly extending flange of said plastic portion having a narrow, perimetrical fold line adjacent and substantially parallel to the sidewall of the plastic portion and an originally thicker terminal portion, the thickness of said terminal position being greatest at its terminal edge wall, said fold line being thinner than the remainder of said flange and the portion of said flange adjacent said fold line thickening gradually toward said edge wall, said flange of the plastic portion being enclosed within the terminal portion of the metal flange of the container, said flange of the plastic portion being displaced by the terminal portion of the metal flange by compression of the originally thicker thermoplastic material, the terminal portion of the metal flange being bent around the displaced thicker thermoplastic material restricting said material therein and substantially completely filling said terminal portion of the metal flange to form a continuous seal thereby, the termination end of said metal flange being bent around the thicker thermoplastic material, the thermoplastic material being bent downwardly from the fold line of the plastic portion, said fold line being juxtaposed directly above the extending termination end of the metal flange to form a closed, double-seamed container.

2. The container of claim 1 wherein the fold line is adapted to permit the thicker thermoplastic material of the flange to be folded in a predictable manner, said thicker thermoplastic material providing a mandrel-like appendage around which the terminal portion of the metal flange is formed.

3. The container of claim 1 wherein the thickness of the outwardly extending flange of the plastic portion increases uniformly from the fold line to the terminal wall, the cross sections of said outwardly extending flange being wedge-shaped.

4. The container of claim 3 wherein the wedge-shaped cross section forms an included angle of between about 10° to about 45°.

5. The container of claim 1 wherein the sidewall, bottom wall and said outwardly extending flange of the plastic portion are multilayered and include an inner layer of a polymer with gas-barrier qualities and outer layers of thermoplastic material.

6. The container of claim 1 wherein the thickness of the material between the termination end and the inside wall section of the metal closure is between about 75% and about 90% of the original thickness of the container sidewall.

* * * * *